US008475213B2

(12) United States Patent
Wang et al.

(10) Patent No.: US 8,475,213 B2
(45) Date of Patent: Jul. 2, 2013

(54) ELECTRICAL CONNECTOR HAVING A MAGNETIC MODULE MOUNTED ON A PADDLE BOARD WITH A GAP BETWEEN THE MODULE AND THE PADDLE BOARD

(75) Inventors: Bing Wang, Kunshan (CN); Jie Zhang, Kunshan (CN); Wan-Li Xuan, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 22 days.

(21) Appl. No.: 13/332,729

(22) Filed: Dec. 21, 2011

(65) Prior Publication Data

US 2012/0156930 A1 Jun. 21, 2012

(51) Int. Cl.
*H01R 13/66* (2006.01)

(52) U.S. Cl.
USPC ..... 439/620.05

(58) Field of Classification Search
USPC ..... 439/620.05, 17–25
See application file for complete search history.

(56) References Cited

U.S. PATENT DOCUMENTS

| | | | | |
|---|---|---|---|---|
| 7,367,851 | B2 * | 5/2008 | Machado et al. | 439/676 |
| 7,393,238 | B2 * | 7/2008 | Xuan et al. | 439/490 |
| 7,413,468 | B1 * | 8/2008 | Little et al. | 439/490 |
| 7,670,183 | B2 * | 3/2010 | Huang et al. | 439/620.05 |
| 7,708,595 | B2 * | 5/2010 | Chow et al. | 439/620.15 |
| 7,749,027 | B2 * | 7/2010 | Chow et al. | 439/620.15 |
| 7,785,135 | B2 * | 8/2010 | Wu | 439/490 |
| 7,793,163 | B2 * | 9/2010 | Goodnow et al. | 714/47.2 |
| 7,841,902 | B2 * | 11/2010 | Chow et al. | 439/620.15 |
| 8,162,695 | B2 * | 4/2012 | Zhang et al. | 439/620.22 |
| 8,272,898 | B2 * | 9/2012 | Chow et al. | 439/620.15 |
| 8,333,599 | B2 * | 12/2012 | Xu et al. | 439/76.1 |

* cited by examiner

*Primary Examiner* — Chandrika Prasad
(74) *Attorney, Agent, or Firm* — Ming Chieh Chang; Wei Te Chung

(57) ABSTRACT

An electrical connector (100) includes an insulative housing (2) and a contact module (4) assembled to the insulative housing. The contact module includes a paddle board (42), a number of mating terminals (43) assembled to the paddle board, and a magnetic module (41) including a cage (410) mounted on the paddle board directly and a magnetic assembly received in the cage. The magnetic assembly has at least a magnetic core (46) and a number of wires (47) winding around the magnetic core and electrically connecting with the paddle board directly.

7 Claims, 5 Drawing Sheets

ELECTRICAL CONNECTOR HAVING A MAGNETIC MODULE MOUNTED ON A PADDLE BOARD WITH A GAP BETWEEN THE MODULE AND THE PADDLE BOARD

BACKGROUND OF THE INVENTION

1. Field of the Invention

The present invention relates to an electrical connector, and more particularly to a modular jack connector having a magnetic module for application in high speed signal transmission systems.

2. Description of Related Art

U.S. Pat. No. 7,785,135 issued to Wu on Aug. 31, 2010 discloses an electrical connector comprising a housing defining an opening, a contact module mounted in the housing and a shield surrounding the housing. The contact module includes a printed circuit board, a plurality of mating terminals mounted at a front face of the printed circuit board and received in the opening, a plurality of converting terminals mounted to a rear face of the printed circuit board, and a plurality of magnetic modules mounted to the rear face of the printed circuit board. The magnetic module includes a cage, a magnetic component received in the cage, and a plurality of connecting terminals insert molded in the cage. Each connecting terminal has a first end wound by the wires of the magnetic component and another end extending outwardly of the cage for being soldered on the printed circuit board.

The cage is mounted on the printed circuit board via the connecting terminals.

An electrical connector having an improved arrangement of magnetic module is desired.

SUMMARY OF THE INVENTION

Accordingly, an object of the present invention is to provide an electrical connector having an improved magnetic module of a simple configuration.

In order to achieve the object set forth, an electrical connector includes an insulative housing and a contact module assembled to the insulative housing. The contact module includes a paddle board, a plurality of mating terminals assembled to the paddle board, and a magnetic module comprising a cage mounted on the paddle board directly and a magnetic assembly received in the cage. The magnetic assembly has at least a magnetic core and a plurality of wires winding around the magnetic core and electrically connecting with the paddle board directly.

The cage encloses the magnetic assembly to perform protecting purpose. The cage is mounted on the paddle board directly. Such a magnetic module has a simple configuration.

Other objects, advantages and novel features of the invention will become more apparent from the following detailed description when taken in conjunction with the accompanying drawings.

DETAILED DESCRIPTION OF THE PREFERRED EMBODIMENT

Figure 1:
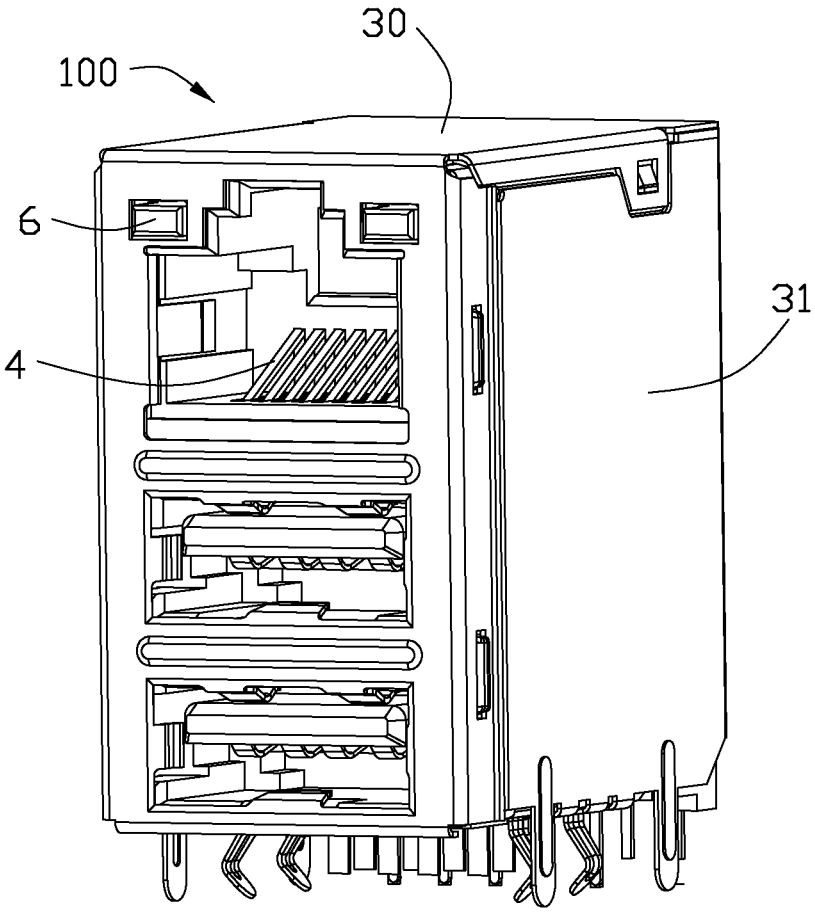
FIG. 1 is an assembled perspective view showing an electrical connector in accordance with the present invention.
Figure 2:
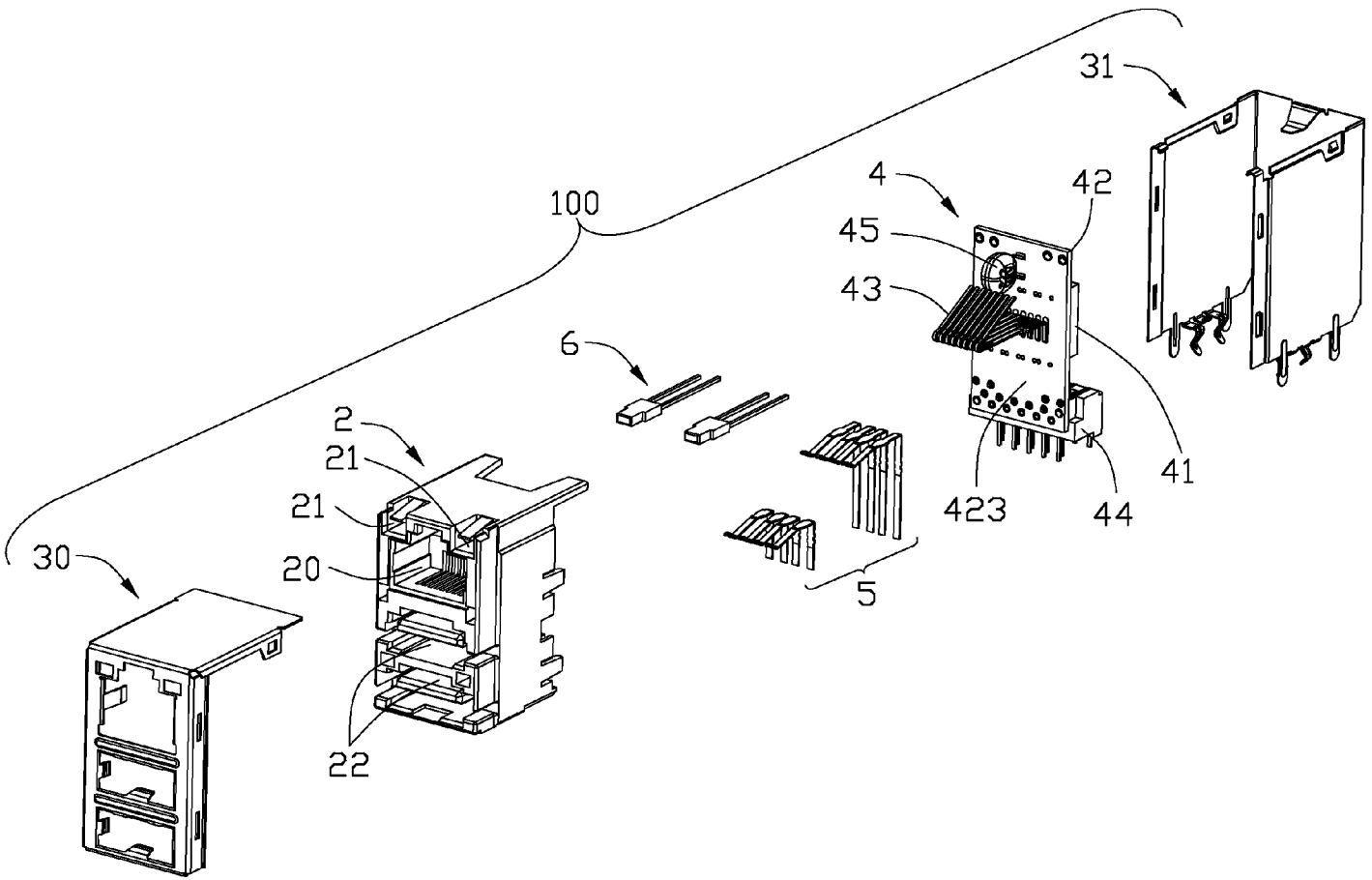
FIG. 2 is an exploded perspective view showing the electrical connector.
Figure 3:
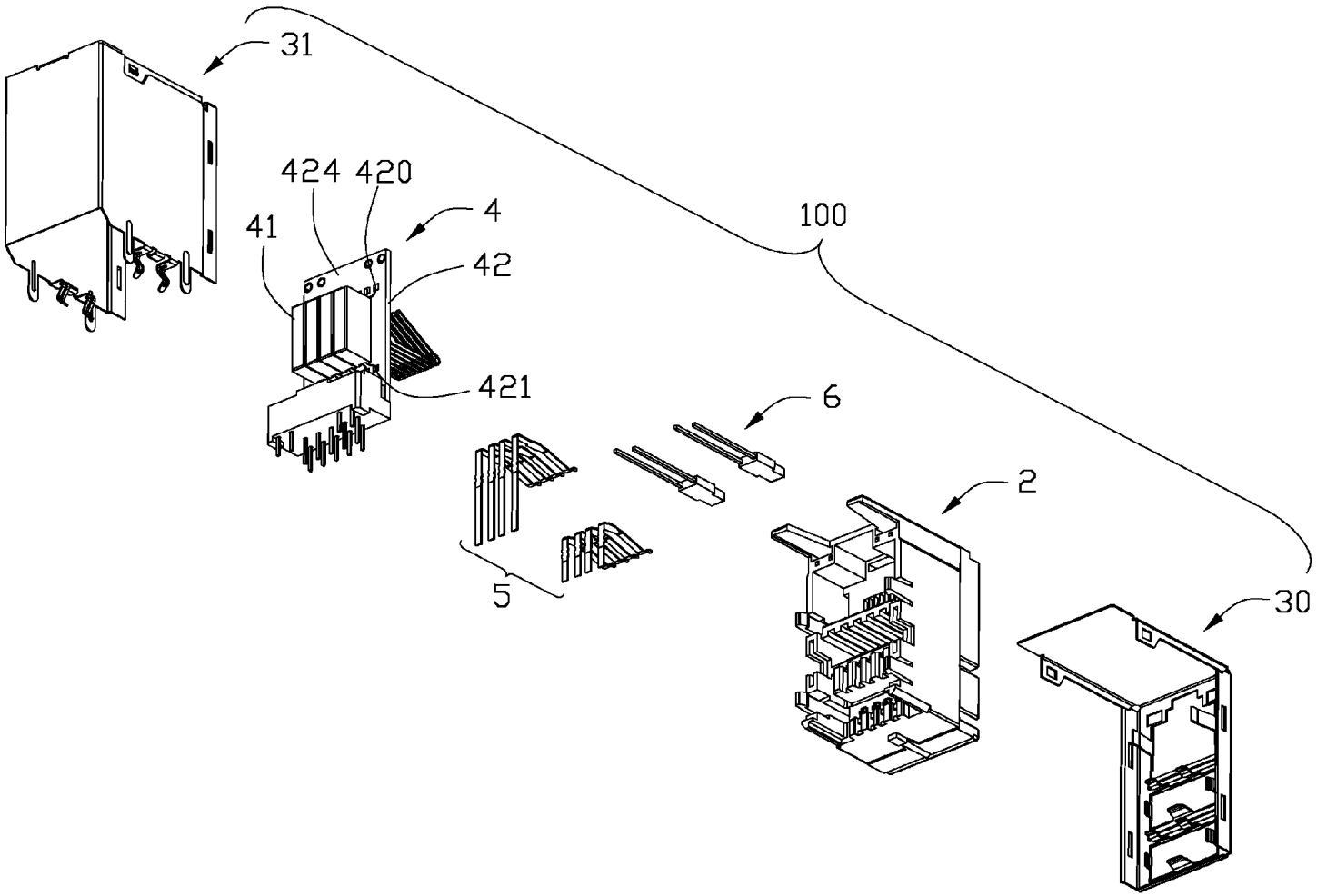
FIG. 3 is another exploded view similar to FIG. 2, taken from another aspect.
Figure 4:
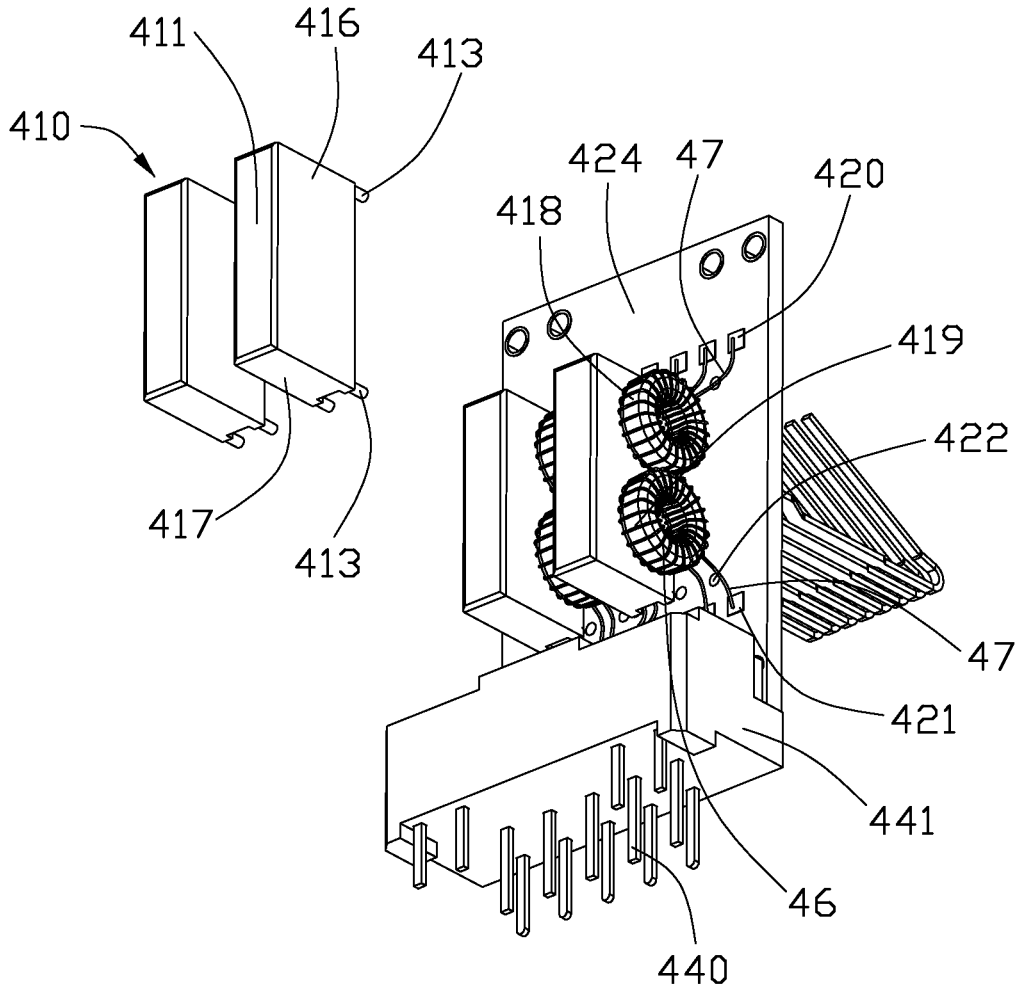
FIG. 4 is a partially exploded view showing a contact module, with two cages separated from the magnetic components.
Figure 5:
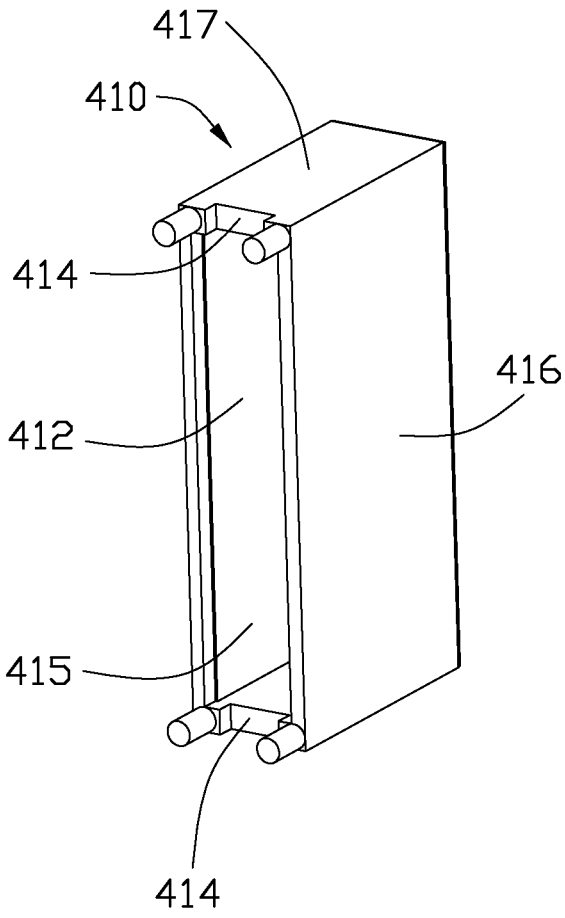
FIG. 5 is a perspective view showing the cage.

Reference will now be made in detail to the preferred embodiment of the present invention. Referring to FIGS. 1-5, an electrical connector 100 mounted on a mother board (not shown) comprises an insulative housing 2, a contact module 4, a plurality of USB (Universal Serial Bus) terminals 5, a pair of LEDs (6), a front shell 30 and a rear shell 31.

The insulative housing 2 defines a receiving space 22 for insertion of the plurality of USB terminals 5, a receiving cavity 20 above the receiving space 22, a pair of receiving recesses 21 for insertion of the pair of LEDs 6.

The contact module 4 includes a paddle board 42 having a front face 423 and a rear face 424, a plurality of mating terminals 43 and a capacitor 45 assembled to the front face 423 of the paddle board 42, a plurality of magnetic modules 41 and a converting module 44 mounted at the rear face 424 of the paddle board 42. The paddle board 42 has a plurality of mounting holes 422 defined thereon, an upper row and a lower row of conductive pads 420, 421 formed at the rear face 424.

Each magnetic module 41 comprises a cage 410 and a magnetic assembly (not labeled) including a pair of magnetic cores 46 and a plurality of wires 47. The pair of magnetic cores 46 have the wires 47 winding therearound to form two magnetic components consist of a transformer 418 and a common mode choke 419. The cage 410 comprises a primary wall 411 parallel to the paddle board 42, a pair of horizontal periphery walls 417, a pair of vertical side walls 416, a receiving room 412 defined by all the walls 411, 416, 417 and an opening 415. There should be a gap presented between the cage 410 and the rear face 424 of the paddle board 42. In this embodiment, the gap comprises a cutout 414 on each periphery wall 417 and adjacent to the opening 415. The cage 410 further has a plurality of integral mounting tails 413.

In assembling of one magnetic module 41, the wires 47 of each magnetic assembly has upper ends extending outwardly of the cage 410 through the cutout 414 for being soldered with the upper row of conductive pads 420, and lower ends extending outwardly of the cage 410 through the cutout 414 for being soldered with the lower row of conductive pads 421. The cage 410 encloses the two magnetic cores 46 in the receiving room 412 through the opening 415. The magnetic cores 46 are secured in the receiving room 412 by glue. The plurality of mounting tails 413 of the cage 410 are inserted in the mounting holes 422 of the paddle board 42.

In assembling of the contact module 4, the plurality of mating terminals 43 and the capacitor 45 are assembled to the front face 423 of the paddle board 42. The converting module 44 has a supporting portion 441 attached to the rear face 424 of the paddle board 42 and a plurality of converting terminals 440 supported in the supporting portion 441 and electrically connecting with the paddle board 42.

In assembling of the electrical connector 100, the contact module 4 is mounted in the insulative housing 2, with the mating terminals 43 received in the receiving cavity 20. The USB terminals 5 are inserted in the receiving space 22 and a pair of LEDs 6 are inserted in the receiving recesses 21. The front shell 30 and the rear shell 31 are attached to the insulative housing 2 for shielding purpose.

The cage 410 encloses the magnetic assembly for protecting purpose. The cage 410 has mounting tails 413 inserted in the mounting holes 422 of the paddle board 42 to mount the cage 410 onto the paddle board 42 directly. Such a magnetic module 41 has a simple configuration.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing; and a contact module assembled to the insulative housing, said contact module including a paddle board, a plurality of mating terminals assembled to the paddle board, and a magnetic module comprising a cage mounted on the paddle board directly and a magnetic assembly received in the cage, said magnetic assembly having at least one magnetic core and a plurality of wires winding around said at least one magnetic core and electrically connecting with the paddle board directly, wherein the magnetic module has a gap between the cage and the paddle board and said wires extending outwardly from the cage through the gap for being soldered on the paddle board.

2. The electrical connector as claimed in claim 1, wherein said paddle board defines a plurality of mounting holes and said cage has a plurality of integral mounting tails inserted in the mounting holes.

3. The electrical connector as claimed in claim 1, wherein said paddle board has a front face and a rear face, said mating terminals being mounted at the front face of the paddle board, said rear face having a plurality of upper and lower conductive pads, said magnetic wires having upper ends soldered on the upper conductive pads and lower ends soldered on the lower conductive pads.

4. The electrical connector as claimed in claim 3, wherein said cage comprises a primary wall parallel with the paddle board, a pair of horizontal periphery walls, a pair of vertical side walls, a receiving room defined by all the walls, and an opening, said magnetic assembly having a pair of magnetic cores received in the receiving room and secured in the receiving room by glue, each magnetic core having respective wires winding therearound to form a magnetic component.

5. The electrical connector as claimed in claim 4, wherein said gap comprises a pair of cutouts respectively at the pair of periphery walls and adjacent to the opening.

6. The electrical connector as claimed in claim 4, wherein said pair of magnetic components consist of a common mode choke and a transformer.

7. The electrical connector as claimed in claim 1, wherein said contact module comprises a converting module having a supporting portion and a plurality of converting terminals supported in the supporting portion and electrically connecting with the paddle board.

* * * * *